US005476204A

United States Patent [19]

Eisenpresser et al.

[11] Patent Number: 5,476,204

[45] Date of Patent: Dec. 19, 1995

[54] AUTOMATED STUD SETTING APPARATUS

[75] Inventors: Marvin Eisenpresser, Hewlett Harbor, N.Y.; Jusis Stanislaw, Garfield, N.J.

[73] Assignee: National Die & Button Mould Co., Ltd., Carlstadt, N.J.

[21] Appl. No.: 257,530

[22] Filed: Jun. 9, 1994

[51] Int. Cl.[6] ..... A41H 37/10

[52] U.S. Cl. ..... 227/18; 227/119; 227/123; 227/135; 227/155

[58] Field of Search ..... 227/15, 18, 155, 227/119, 135, 136, 139, 123, 154

[56] References Cited

U.S. PATENT DOCUMENTS

| | | | |
|---|---|---|---|
| 4,019,666 | 4/1977 | Foults | 227/119 |
| 4,278,194 | 7/1981 | Ersoy | 227/18 |
| 4,703,882 | 11/1987 | Herten | 227/18 |
| 4,765,524 | 8/1988 | Yoshieda | 227/18 |
| 4,978,046 | 12/1990 | Hagmann et al. | 227/119 |
| 5,181,315 | 1/1993 | Goodsmith | 227/119 |
| 5,263,627 | 11/1993 | Breuer et al. | 227/119 |

*Primary Examiner*—Scott A. Smith
*Attorney, Agent, or Firm*—Cobrin Gittus & Samuel

[57] ABSTRACT

An automated apparatus for attaching studs to fabric such as leather jackets jeans, shirts or the like. The apparatus including a feeder for supplying studs to the apparatus, a stud support, a stud placement member, a stud driving member for guiding a stud through its full path of travel until the legs contact a fabric into which they are inserted, a stud positioning member configured to displace the stud placement member and to displace the stud support and a stud fastening member disposed below the stud driving member for bending at least one leg of a stud upon the stud driving member guiding the stud through its full path of travel. The stud support and the stud placement member hold a stud in place for the stud driving member to drive a stud into a fabric and contacting the stud fastening member which bends at least one leg of a stud to fasten a stud to a fabric.

14 Claims, 9 Drawing Sheets

FIG.6A
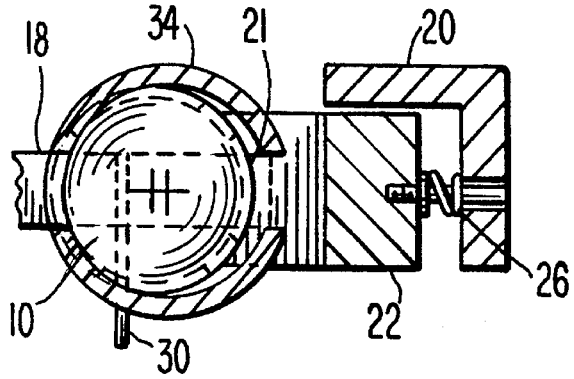
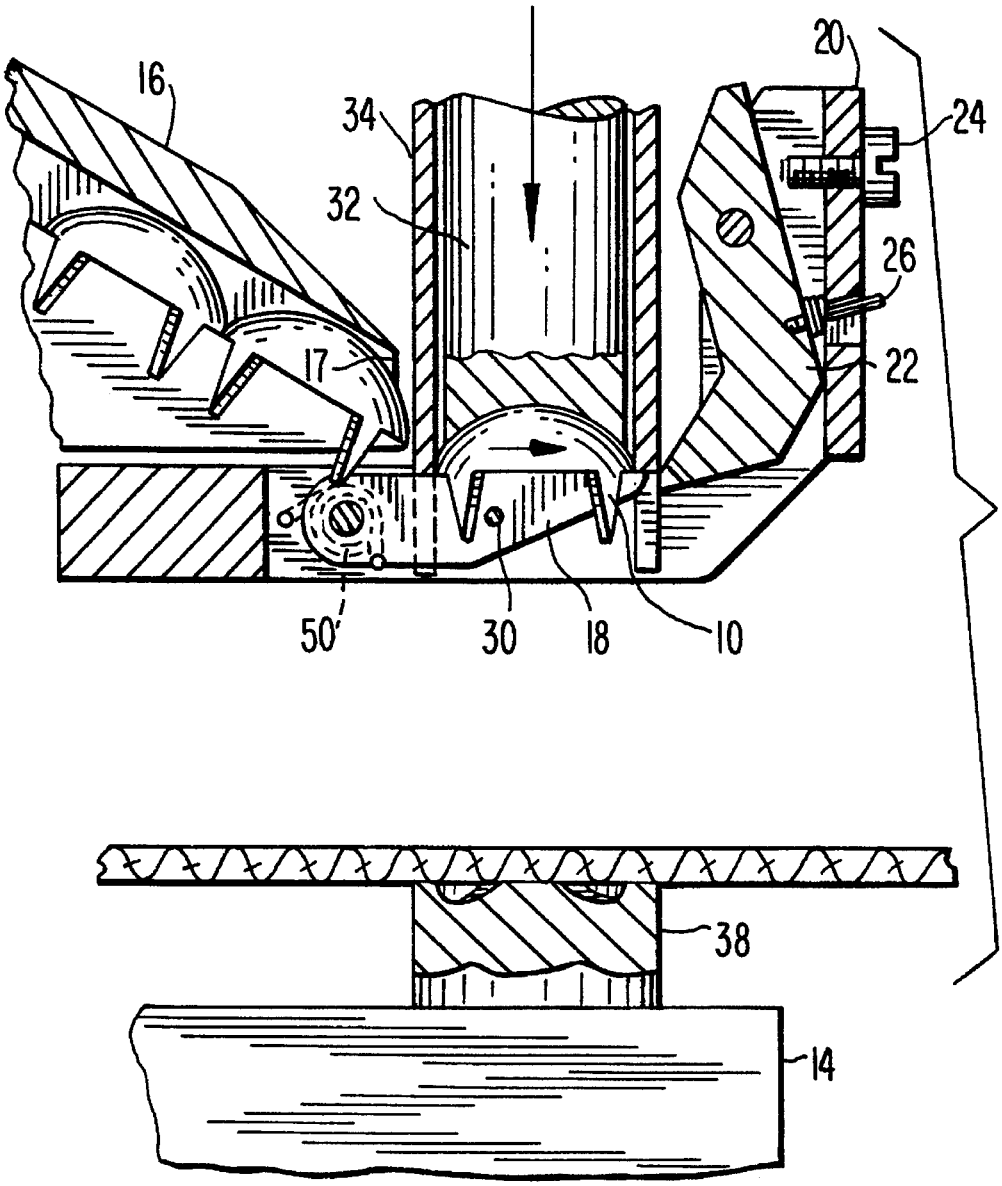
FIG.7

60
66
50
18
66
32
34
10
60
66

64
18
10
66
60
11
32
34
11

AUTOMATED STUD SETTING APPARATUS

BACKGROUND OF THE INVENTION

This invention relates generally to setting tools and more particularly to an automated apparatus for setting studs into garments.

Objects that are typically secured to garments for decorative purposes are referred to in the art as both "studs" and "nails." Generally, the nail type of decorative fastener has a flat head whereas the stud type of fastener has a slightly rounded or convex head. Other shaped heads of course may be provided. For purposes of the present application the term "stud" is meant to include studs, nails or decorative members of various other shapes provided with leg members for securing to a garment.

It is common practice to provide decorative patterns of studs on garments such as blue jeans, denim jackets, leather jackets, shirts and the like. Normally, the stud is provided with points or legs in the form of integral prongs extending from the head portion. In setting or attaching the stud to material, the prongs are simply pushed through the material and then bent preferably inwardly to secure the stud in place.

Various tools have been provided in the past for setting stud shaped objects which in some cases are not studs and do not perform the same function as studs. For instance there are bung tin drivers, rivet setters, shoe plate tools and snap attaching tools which attach objects that are not part of the relevant art. Examples of such devices are set forth in the following patents:

| U. S. Pat. No. | Inventor |
|---|---|
| 822,918 | Brooks |
| 1,179,172 | Frankel |
| 1,289,526 | Nye |
| 1,500,253 | Miller |
| 2,020,389 | West |
| 3,900,143 | Gallman |
| 3,964,660 | Hensley |
| 4,412,640 | Sugiyama et al. |

U.S. Pat. No. 822,918 to Brooks and U.S. Pat. No. 1,179,172 to Frankel both disclose Bung Tin Drivers.

U.S. Pat. No. 1,289,526 to Nye and U.S. Pat. No. 1,500,253 to Miller both disclose Rivet Setting Tools.

U.S. Pat. No. 2,020,389 to West discloses a Shoe Plate Tool.

U.S. Pat. No. 3,900,143 to Hensley discloses a Snap Attaching Tool.

U.S. Pat. No. 3,900,143 to Gallman and 4,412,640 to Sugiyama et al. both disclose Stud Setting Tools.

Generally the stud setting tools are in the form of manually operated devices that allowed a user to load one stud, set that stud, reload the setting tool then set another stud. These tools make the job of setting studs very laborious and very time consuming. While there are also automated stud setting tools, these devices generally feed a stud to an attaching area and drive the stud into the fabric in one relative motion without first aligning the stud to the driver. Because the studs are not always aligned properly before they are inserted into the fabric, these devices frequently suffer from a jamming problem.

When a stud is misfed, as frequently occurs, the resulting jam causes machine down-time which is expensive in terms of lost productivity. The jams are generally difficult to clear and waste time and effort on the part of the operator. Thus, there exists the need for an improved stud setting machine which jams less frequently and allows for easy access to the studs in the event of a jam while providing high speed operation.

It is accordingly an object of the invention to provide an automated stud setting apparatus.

It is another object of the invention to provide an automated stud setting apparatus that jams infrequently.

It is a further object of the invention to provide an automated stud setting apparatus that allows for easy access to a stud in the event of a jam.

SUMMARY OF THE INVENTION

The foregoing objects are attained by the present invention, which provides a stud setting apparatus. The invention utilizes preformed studs with each of the studs having a head and at least one leg. The invention includes a feeder for continuously supplying studs to a stud location from which they are inserted into a fabric, a pivotable stud support, a stud placement member for providing proper placement of a stud on the pivotable stud support, a stud driving member having a stud engaging section, a stud positioning member and a stud fastening member.

The invention will next be described in connection with certain illustrated embodiments; however, it should be clear to those skilled in the art that various modifications, additions and subtractions can be made without departing from the spirit or scope of the claims.

BRIEF DESCRIPTION OF THE DRAWINGS

For a fuller understanding of the nature and objects of the invention, reference should be made to the following detailed description and accompanying drawings, in which:

FIG. 6A depicts a cross sectional top view of the automated stud setting apparatus, sectioned along line 6A—6A of FIG. 6; including details of the notched end of the pivotable stud placement member;

FIG. 7 depicts a cross sectional side view of the automated stud setting apparatus shown in FIG. 6; including details of the movement of the stud driving member, the movement of the stud positioning member and the movement of the pivotable stud placement member;

DESCRIPTION OF ILLUSTRATED EMBODIMENTS

Figure 1:
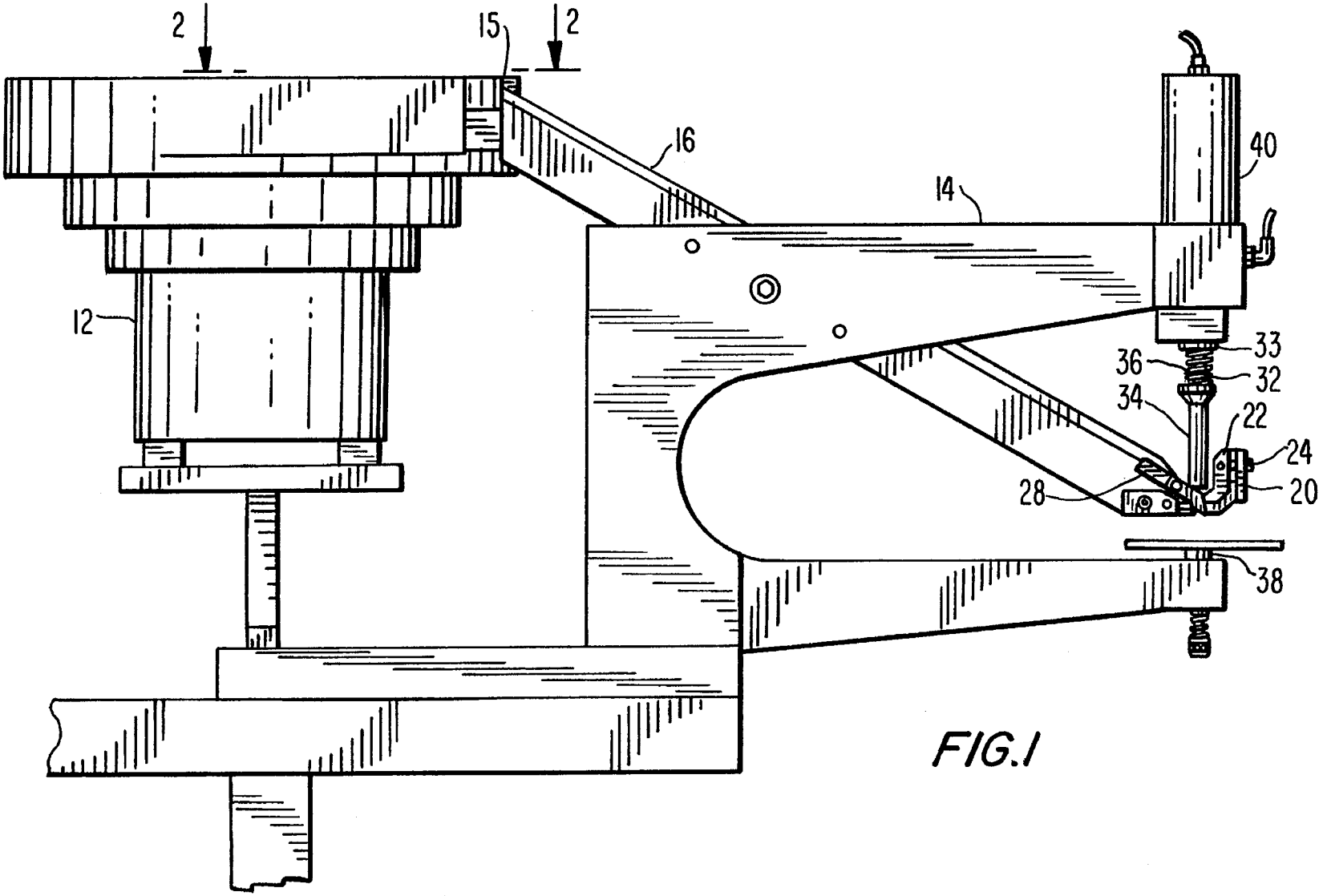
FIG. 1 depicts a side view of an automated stud setting apparatus in accordance with the invention; including details of the feeder, the frame, the pivotable stud placement member, the anti-jam lever, the stud driving member, the stud positioning member, the stud fastening member, the stud driving member actuator and the spring.

The overall configuration of the present invention is depicted in FIG. 1. The invention includes a feeder having a bowl 12 and a ramp member having a hollow channel 16, a frame 14, a pivotable stud support 18, a support member 20, a pivotable stud placement member 22, an adjusting member 24, a biasing spring 26, an anti-jam lever 28, a pin 30, a stud driving member 32, a stud positioning member 34, a spring 36, a stud fastening member 38 and a stud driving member actuator 40.

As depicted in FIG. 1, the bowl 12 is supported by the frame 14 and is coupled to the ramp member 16. The ramp member 16 is attached to the frame 14 such that there is a downward slope from the upper end 15 to the lower end 17. The stud fastening member 38 is disposed within the frame 14 directly below the stud driving member 32 and has a circular groove (not shown in FIG. 1) for receiving and bending the leg portions of the stud 10. The stud driving member actuator 40 is also disposed within the frame 14 directly above the stud driving member 32 and is coupled to stud driving member 32 in such a way as to force stud driving member 32 down into stud fastening member 38 when the stud driving member actuator 40 is activated. In the preferred embodiment, the stud driving member 32 is also disposed within the frame 14 and has a shoulder 33 which abuts frame 14 when stud driving member 32 is in its first non-engaged position.

Spring 36 is attached to shoulder 33 of the stud driving member 32 at one end of the spring and to a funnel shaped portion of stud positioning member 34 at the other end. By attaching stud positioning member 34 to stud driving member 32 in this manner it allows for the movement of stud driving member 32 and stud positioning member 34 jointly and relative to each other. It will be obvious to one skilled in the art that these two parts can be connected in other ways that would also allow for relative movement between the stud driving member 32 and stud positioning member 34.

The anti-jam lever 28 is pivotally attached to the ramp member 16 proximal to the lower end 17 and attached by pin 30 to pivotable stud support 18 (not shown in FIG. 1). Support member 20 is also attached to the ramp member 16 proximal to the lower end 17 at the proximal end portion of support member 20. Support member 20 also has a distal end portion which is bent upward to form a ninety degree angle or approximately a ninety degree angle with the proximal end portion. The distal end portion also has a second bend that forms a right angle or approximately a right angle with the rest of the support member 20.

The pivotable stud support 18 is pivotally attached to the support member 16. A spring element 50 that urges the pivotable stud support 18 towards its first position is attached between the pivotable stud support 18 and the support member 20. The first position of the stud support 18 being parallel to the stud fastening member 38 and perpendicular to the stud driving member 32. The pivotable stud support member 18 is moveable to a second position which is parallel to the stud driving member 32 and perpendicular to the stud fastening member 38.

The pivotable stud placement member 22 is also pivotally attached to the support member 20 near the distal end portion of the support member 20. The adjusting member 24 which is a screw or the like is adjustably connected to the support member 20 so that it abuts the pivotable stud placement member 22 in such a way as to enable a user to adjust the position of the notched end 21 of the pivotable stud placement member 22 relative to the hollow channel 16 by adjusting the adjusting member 24. The biasing spring 26 is connected between the pivotable stud placement member 22 and the support member 20 below the adjusting member 24 thus continually biasing the pivotable stud placement member 22 toward the adjusting member 24. The biasing spring 26 is connected to the pivotable stud placement member 22 by a rod that is connected to the pivotable stud placement member 22 and which is moveable in a slot formed in the support member 20.

Figure 5:
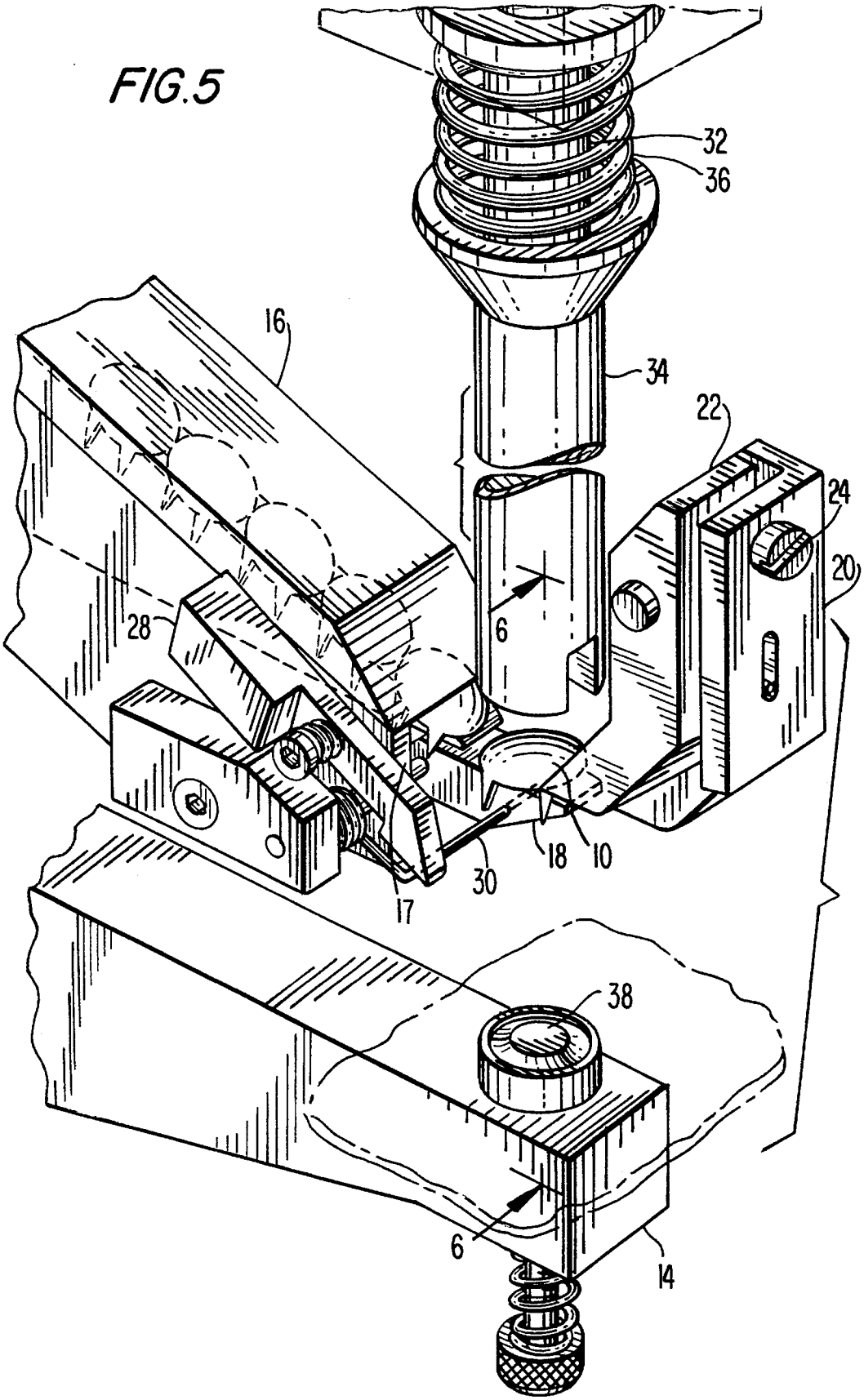
FIG. 5 depicts a perspective view of an automated stud setting apparatus as shown in FIG. 1; including details of a stud, a ramp member, the pivotable stud support, the pivotable stud placement member, the adjusting member, the anti-jam lever, the stud driving member, the stud positioning member, the stud fastening member and the spring.

As depicted in FIG. 5 the anti-jam lever 28 in the preferred embodiment is a single structure that is coupled to the ramp portion 16 through a central pivot point located on a front portion of the anti-jam lever 28. The anti-jam lever 28 is generally rectangular in shape but has a portion cut away such that the front portion of the anti-jam lever 28 has about half the depth of a rear portion of the anti-jam lever 28. A lower portion of the front portion is also carved out such that the lower edge of the front portion is recessed as compared to the lower edge of the rear portion. Further, the tip portion, located at the end of the front portion, is shaped such that the upper edge of the tip stops then angles down to the lower edge of the tip such that the lower edge of the anti-jam lever 28 is longer than the upper edge of the anti-jam lever 28.

Figure 6:
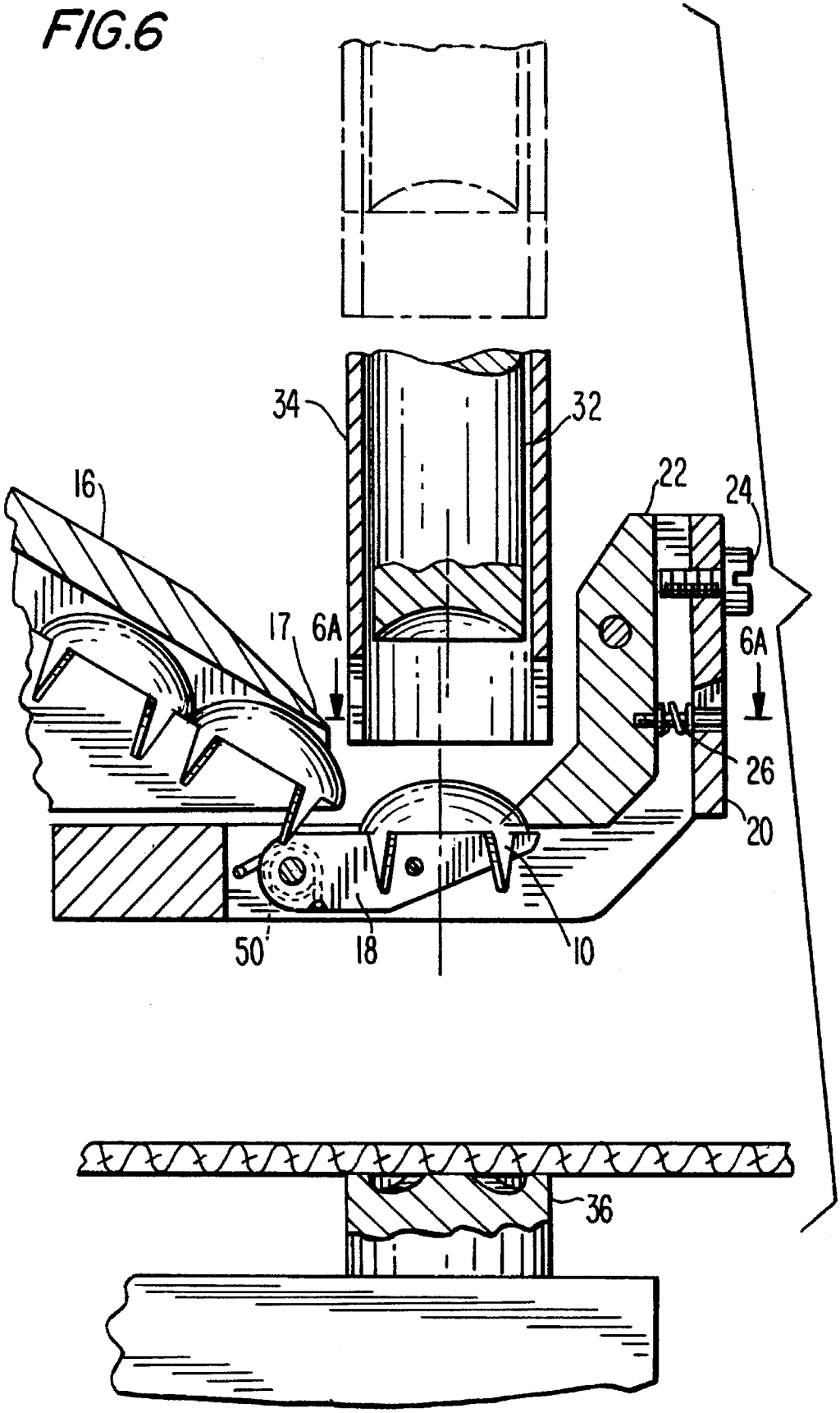
FIG. 6 depicts a cross sectional side view of the automated stud setting apparatus in accordance with the invention, sectioned along line 6—6 of FIG. 5; including details of a stud, the hollow channel of the ramp member, the pivotable stud support, the pivotable stud placement member, the adjusting member, the biasing spring, the stud driving member and the stud positioning member.

FIGS. 5–8 all portray the pivotable stud placement member 22. This part is generally L-shaped with three of its six corners removed. As depicted in FIG. 6, the pivotable stud placement member 22, is attached to the apparatus in the shape of a backwards "L," wherein a portion of the upper, top left-hand corner, a portion of the bottom right-hand corner and a portion of the lower, top left-hand corner of the "L" have been removed. The pivotable stud placement member 22 is pivotally connected to the distal end portion of the support member 20 in the first bend portion, through an aperture in the stud placement member 22 which is located in the upper portion of the L below the missing corner portion. As depicted in FIG. 6A, the lower left-hand edge of the pivotable stud placement member 22 has an arcuate notched end 21 for receiving a portion of the stud as it is delivered to the pivotable stud support 18 from the feeder.

Figure 8:
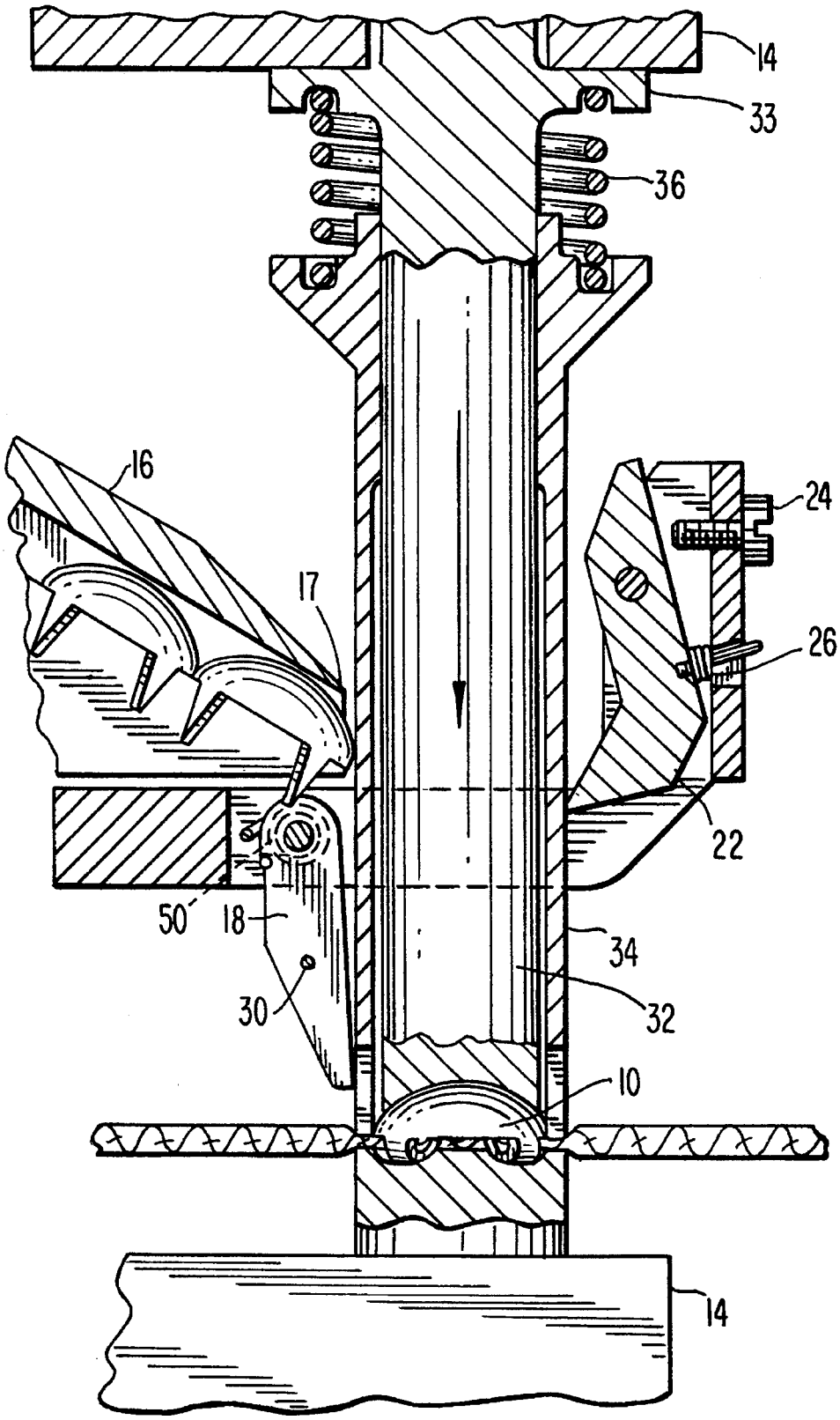
FIG. 8 depicts a cross sectional side view of the automated stud setting apparatus shown in FIG. 7; including details of the stud driving member in its second engaged position and a stud attached to a fabric.

FIGS. 6, 7 and 8 all depict the pivotable stud support 18 which is also a singular piece. The pivotable stud support 18 is generally rectangular in shape having one rounded end and one end with a portion of its lower corner removed. The pivotable stud support 18 has an aperture for receiving the pin 30 above the removed corner and there is an aperture located at the focus of the rounded end for receiving a rod that connects the pivotable stud support 18 to the ramp member 16.

The stud driving member 32 as depicted in FIGS. 1, and 5–8, is generally rod shaped and has a shoulder 33 as depicted in FIGS. 1 and 8. The shoulder 33 abuts the frame 14 when the stud driving member is in the first non-engaged position. The shoulder is generally washer shaped and it has a groove in its bottom face for receiving spring 32. When the stud driving member 32 is in its second engaged position (as illustrated in FIG. 8), a concave stud engaging section of the stud driving member 32 is in receipt of a stud 10 and the stud 10 is in contact with the stud fastening member 38.

The stud positioning member 34 as depicted in FIGS. 1, and 5–8 is cylindrical in shape and has a funnel shaped upper end that is coupled to the spring 36. The end opposite the funnel shaped end has a rectangular slot for receiving a portion of the pivotable stud support 18 when the stud positioning member 34 moves from its top position to its bottom position. At its top position the stud positioning member 34 is above the pivotable stud support 18 but lower than the stud driving member 32. At its bottom position, the stud positioning member 34 is in contact with the stud fastening member 38.

Figure 9:
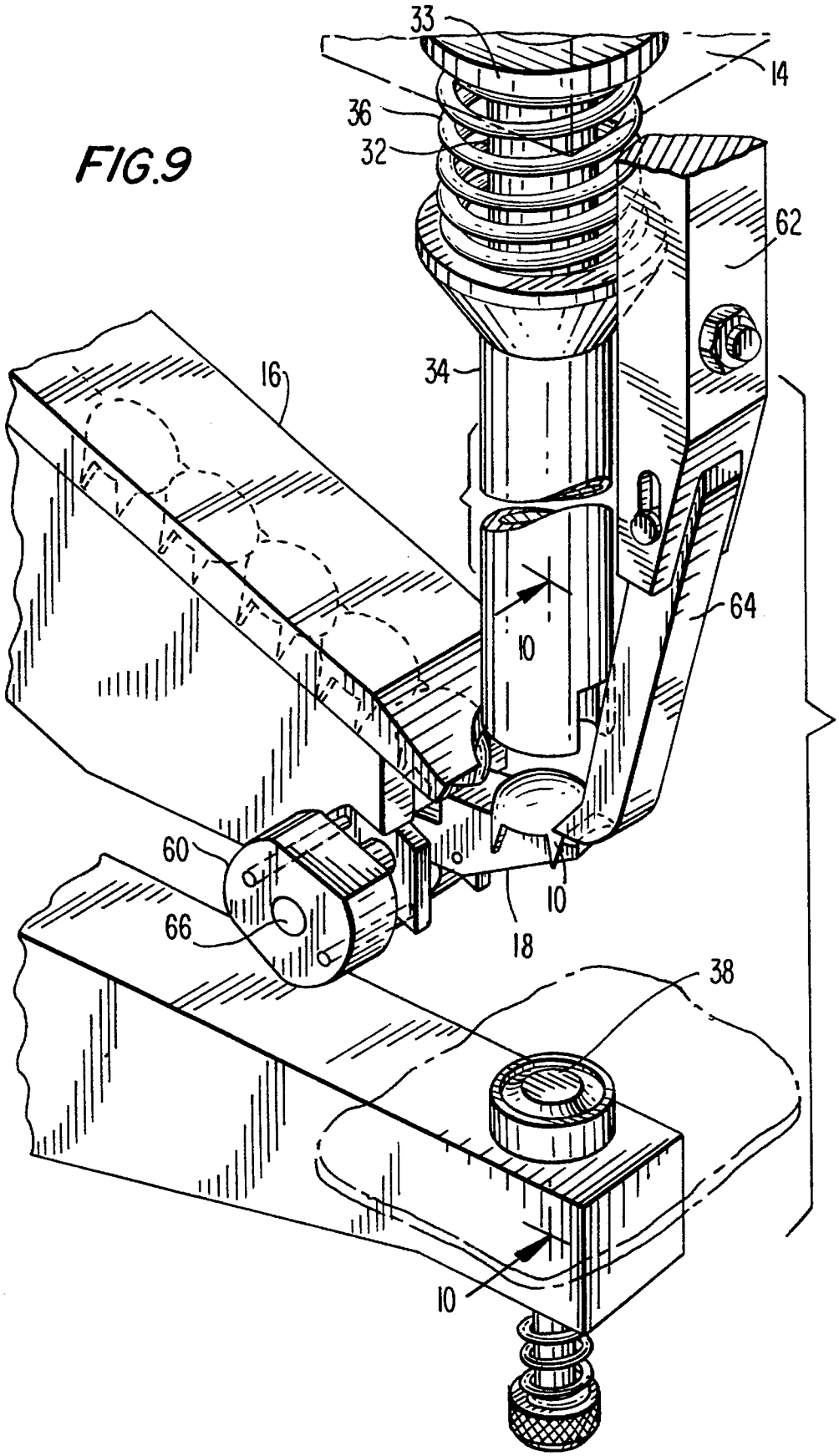
FIG. 9 depicts a perspective view of a second embodiment of the invention, including details of the stud, the ramp member, the pivotable stud support, the pivotable stud placement member, the adjusting member, an anti-jam knob, the stud driving member, the stud positioning member, the stud fastening member and the spring.
Figures 10, 11:
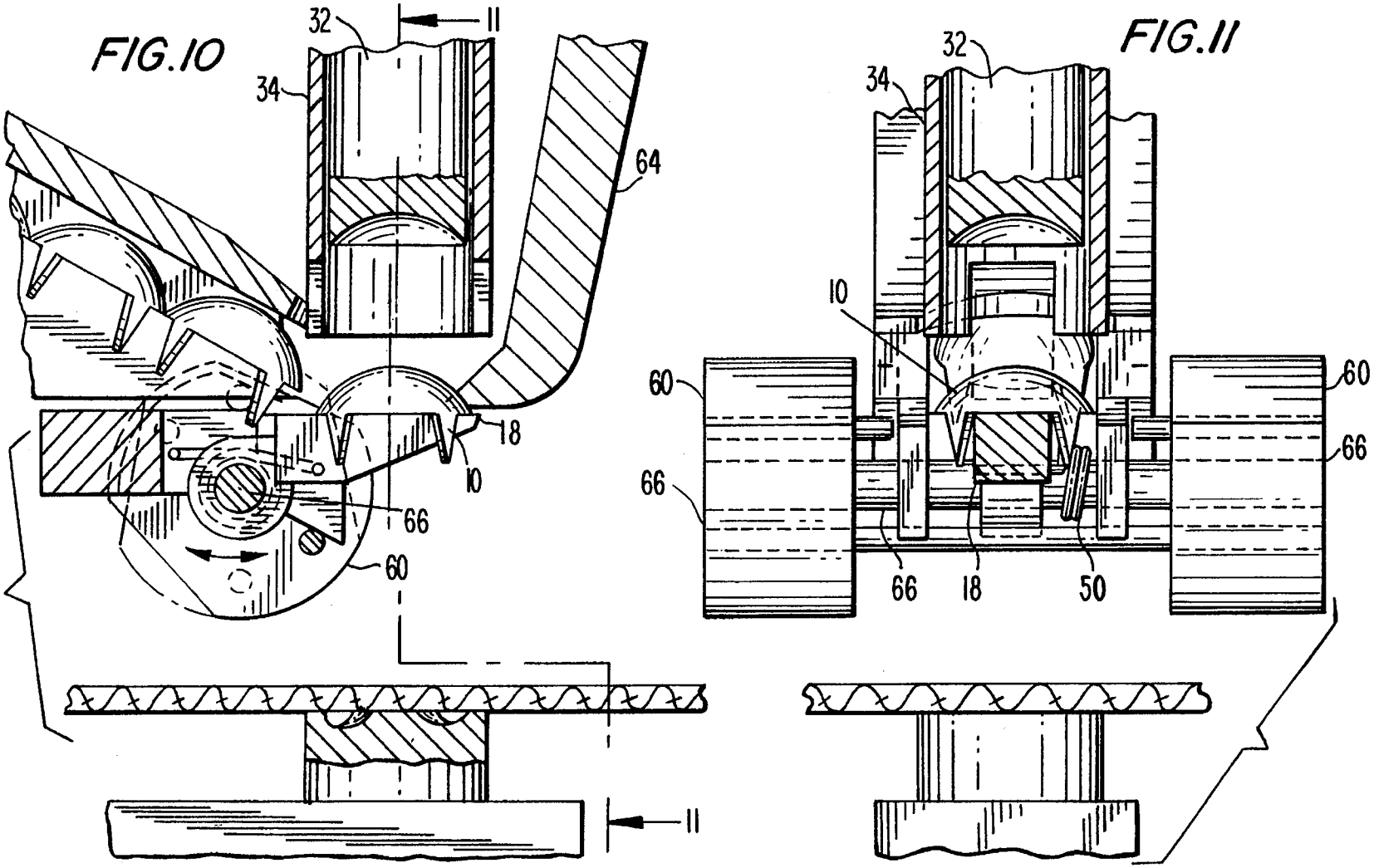
FIG. 10 depicts a cross sectional side view of the automated stud setting apparatus shown in FIG. 9, sectioned along line 10—10 of FIG. 9; including details of a stud, the hollow channel of the ramp member, the pivotable stud support, the pivotable stud placement member, the stud driving member and the stud positioning member.
FIG. 11 depicts a cross sectional front view of the automated stud setting apparatus shown in FIG. 9, sectioned along line 11—11 of FIG. 10; including details of the stud, the spring element and the an anti-jam knob.

FIGS. 9–11 depict a second embodiment of the invention. This embodiment has many of the same features as the first embodiment with the exception of anti-jam lever 18, pin 30, support member 20, stud placement member 22, adjusting member 24 and biasing spring 26. As such like elements will have the same numbers in each embodiment. As depicted in FIG. 9, the anti-jam lever 18 has been replaced by anti-jam knob 60, and support member 20, stud placement member 22, adjusting member 24 and biasing spring 26 have been replaced by support member 62 and stud placement member 64.

Anti-jam knob 60 is circular in shape having semicircular portions removed on opposite sides thereof and is located on opposite sides of the ramp member 16, as seen in FIGS. 9 and 11. It will be obvious that the shape can also be other shapes such as square, octagonal etc. There are also two rods disposed within and extending out of the anti-jam knob 60, on opposite sides of a rod 66 which is disposed within and extends out from a central portion of the anti-jam knob 60, that attach the anti-jam knob to the pivotable stud support 18. These rods allow the moving of the pivotable stud support 18 when anti-jam knob 60 is selectively rotated. Anti-jam knob 60 is pivotally attached to the ramp member 16 by rod 66, proximal the lower end 17. The pivotable stud support 18 is attached to the rod 66 on opposite sides of the ramp member 16.

Support member 62 is attached to the frame 14 proximal to shoulder 33 of stud driving member 32 such that it extends downward from frame 14 and may be parallel to the stud driving member 32. Support member 62 has a hollow lower portion where stud placement member 64 is connected. As seen in FIGS. 9 and 10, the stud placement member 64 is not parallel to the stud driving member 32. The stud placement member 64 is long and has a rectangular shaped body with an angled lower tip portion that juts out towards the stud driving member 32; similar to the stud placement member 22. It will be apparent to one skilled in the art that the stud placement member 64 can be different shapes such as cylindrical or hexagonal so long as it is elongated to reach the pivotable stud support 18.

Figure 2:
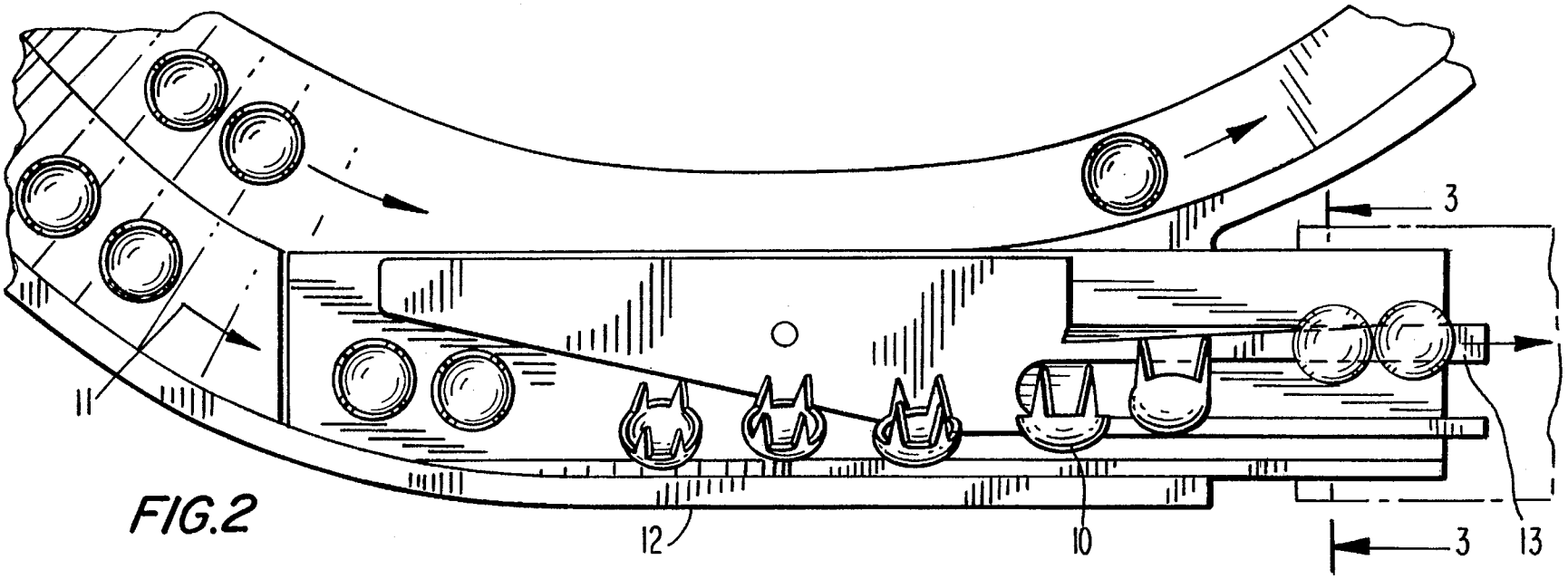
FIG. 2 depicts a cross sectional view of a portion of the feeder, sectioned along line 2—2 of FIG. 1; including details of a bowl and a stud.
Figure 3:
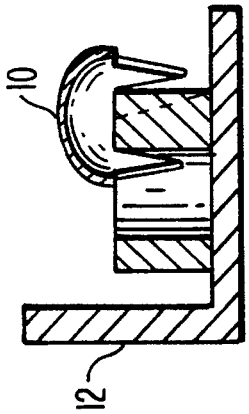
FIG. 3 depicts a cross sectional view of a portion of the feeder, sectioned along line 3—3 of FIG. 2; including details of a bowl and a stud.
Figure 4:
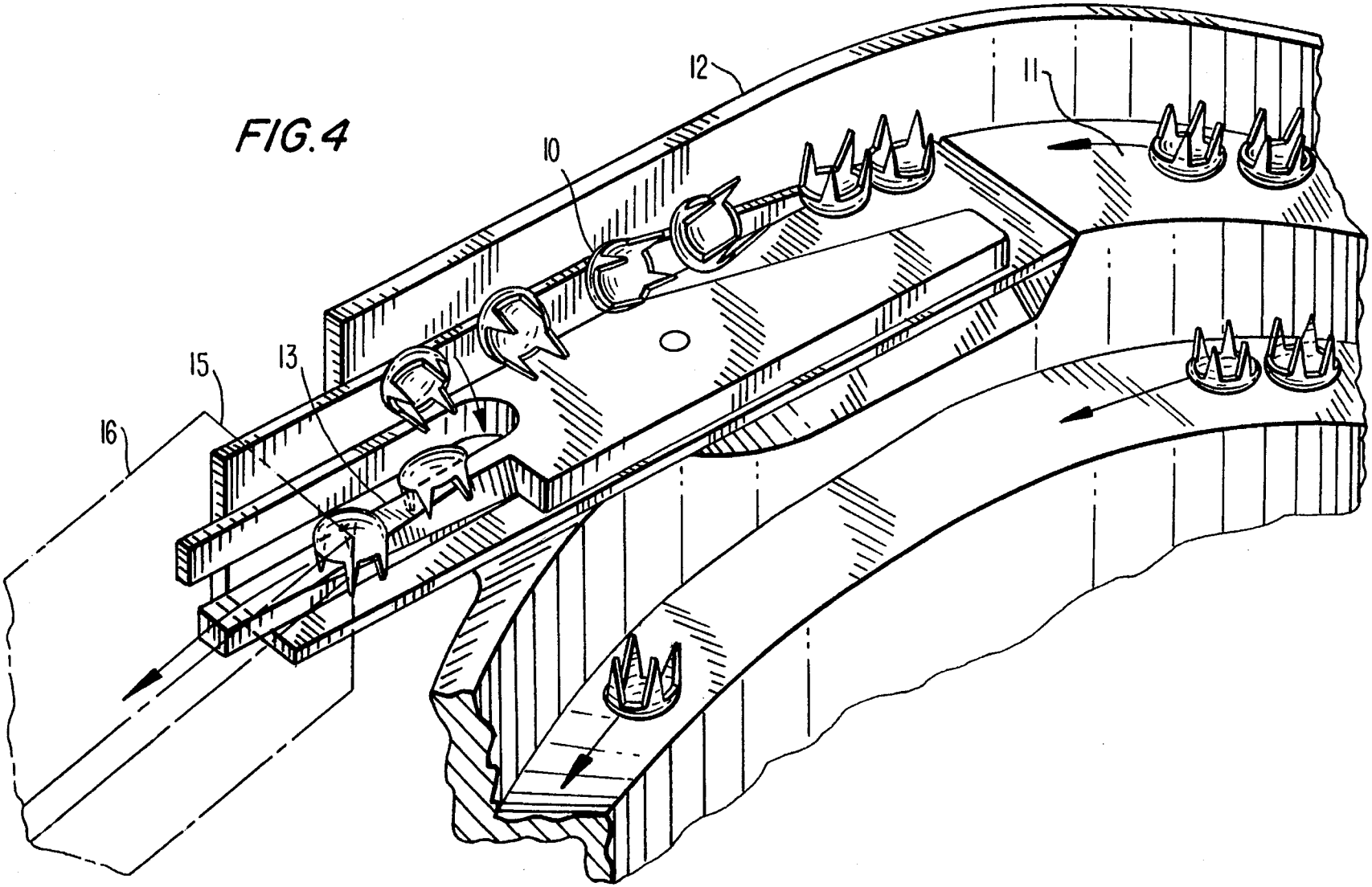
FIG. 4 depicts a perspective view of a portion of the feeder, including details of the movement of a stud within a bowl and the movement of a stud from a bowl to a ramp member.

In accordance with known principles of operation employed in automated stud setting devices, a stud 10 is loaded into the bowl 12 where it spirals up a rim 11 along the inner wall off the bowl 12. This spiraling movement is a result of vibrating the bowl 12. While the stud 10 travels along the rim 11 it is upside down such that the leg portions are above the head portion as depicted in FIGS. 2 and 4. Once the stud 10 reaches the top of the bowl 12 it is flipped such that the leg portions are below the head portions. The stud 10 then rides along a ridge member 13 such that the leg portions straddle the ridge member 13 until the stud 10 is deposited into the hollow channel 16 as depicted in FIGS. 2, 3 and 4.

In conventional automated stud setting devices utilizing a bowl 12 and a ramp member having a hollow channel 16 there is a tendency for the studs to be misfed to the attaching portion of the device and to jam. These jams cause down time for the machine because they are usually difficult and time consuming to remove. The first embodiment of the invention obviates this problem by utilizing pivotable stud support 18, anti-jam lever 28, pin 30, pivotable stud placement member 22 and stud positioning member 34. The preferred embodiment obviates this problem by utilizing pivotable stud support 18, anti-jam knob 60, and stud placement member 64. In particular, the pivotable stud support provides a uniform place for the stud to sit prior to being set into the fabric rather than having it free floating adjacent the fabric as the prior art teaches. The pivotable stud placement member 22 or the stud placement member 64 insures proper placement of the stud 10 on the pivotable stud support 18 so the stud positioning member 34 will consistently be able to position the stud directly under the stud driving member 32. Anti-jam lever 28 is coupled to the pivotable stud support 18 by pin 30 and anti-jam knob 60 is coupled to the pivotable stud support 18 by rods so that in the event of a jam, the anti-jam lever 28 or the anti-jam knob 60 can be manually rotated which in turn rotates the pivotable stud support 18 from its first position to its second position and allows the jammed stud 10 to be easily and quickly removed.

FIG. 1 depicts a side view of the automated stud setting apparatus in accordance with one embodiment of the invention. A group of preformed studs 10 is loaded into the bowl 12 where it is arranged in single file and fed into the hollow channel 16 at an upper end 15. The stud 10 travels through the hollow channel 16 and exits from a lower end 17. When the lowermost stud 10 exits from the hollow channel 16 it lands on pivotable stud support 18 and a portion of it is received by an arcuate notched end 21 of pivotable stud placement member 22. Stud 10 comes to rest on pivotable stud support 18 below stud driving member 32 but not concentric with the stud driving member 32 as illustrated in FIGS. 6 and 6A. In the embodiments the stud 10 is placed off center by the pivotable stud placement member 22 or the stud placement member 64 from the stud driving member so that it remains close enough to the hollow channel 16 to prevent a next lowermost stud from exiting the hollow channel 16.

FIGS. 5–8 depict the chain of events that takes place once the stud 10 is at rest on the pivotable stud support 18. FIGS. 5 and 6 depict the automated stud setting apparatus with the stud 10 loaded on the pivotable stud support 18 in preparation for setting the stud 10 to a fabric such as leather, denim cotton or the like. The legs of stud 10 straddle the pivotable stud support 18 thus insuring a flat lie of the stud almost every time a stud is loaded. Stud driving member 32 starts in a first non-engaged position which is located above the pivotable stud support 18 such that there is enough room for a stud 10 to be loaded onto the pivotable stud support 18. Stud positioning member 34 starts in a position also above the pivotable stud support 18 such that there is enough room for a stud 10 to be loaded onto the pivotable stud support 18, but lower than the stud driving member 32.

An operator can actuate a pneumatic stud driving member actuator 40. While in the preferred embodiment the actuator is pneumatic it will be obvious to one skilled in the art that the actuator can also be a pulse motor or the like which moves stud driving member 32 to its second engaged position. As exemplified in FIGS. 6–8 the stud driving member 32 and the stud positioning member 34 move in relative unison until the stud positioning member 34 reaches its bottom position. When this occurs the spring 32 compresses and the stud driving member 32 continues to travel through its path until it reaches its second engaged position and the stud 10 is set to the fabric.

FIG. 7 depicts the stud positioning member 34 as it makes contact with the pivotable stud support 18. FIG. 7 also depicts the stud driving member 32 as it makes contact with the stud 10. The stud positioning member 34 has a slotted end portion 35 for receiving a portion of the pivotable stud support 18 when the stud positioning member 34 moves between its top position and its bottom position. During this movement the stud positioning member 34 makes contact with and displaces the pivotable stud placement member 22, it makes contact with and centers the stud 10 so that stud 10 and stud driving member 32 become concentric and it prevents a next lowermost stud from exiting the hollow channel 16. Further, the stud positioning member 34 receives the portion of the pivotable stud support 18 in the slotted end portion 35 and moves the pivotable stud support 18 from its first position to its second position.

The stud driving member 32 has a stud engaging section 31 which is concave for receiving the stud 10 when the stud driving member 32 moves between its first non-engaged position and its second engaged position. During this movement the stud engaging section 31 of the stud driving member 32 receives the stud 10. The stud driving member 32 guides the stud 10 through its full path of travel until at least one leg contacts a fabric into which it is inserted and further into contact with the stud fastening member 38 which causes the at least one leg of the stud 10 to curl or bend preferably inward, thus attaching the stud to the material. When the stud driving member 32 and the stud positioning member 34 return to their original positions, the pivotable stud support 18 moves back to its first position, the pivotable stud placement member 22 returns to its original position and the next lowermost stud 10 in the hollow channel 16 is loaded onto pivotable stud support 18.

It will thus be seen that the invention efficiently attains the objects set forth above, among those made apparent from the preceding description. In particular, the invention provides an automated apparatus for setting studs. Those skilled in the art will appreciate that the configurations depicted in FIGS. 1–11 lessen the likelihood that a stud will get jammed in the apparatus, allow for easy access to the stud should it get jammed and allow for high speed operation.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

Having described the invention, what is claimed as new and secured by Letters Patent is:

1. An automated apparatus for attaching studs to fabric with each of the studs having a head portion and at least one leg comprising:

a feeder for supplying studs to a location from which they can be attached to a fabric;

a pivotable stud support shaped to allow a stud delivered from said feeder to rest thereon, said pivotable stud support being movable between a first position and a second position;

a stud placement member for restricting movement of a stud delivered from said feeder to said pivotable stud support;

a stud driving member movable between a first non-engaged position and a second engaged position, said stud driving member having a stud engaging section for receiving a stud resting on said pivotable stud support;

a stud positioning member movable with and relative to said stud driving member and configured to displace said stud placement member and said pivotable stud support; and a stud fastening member disposed below said stud driving member for bending at least one leg of a stud upon said stud driving member moving from its first non-engaged position to its second engaged position.

2. An automated apparatus for attaching studs to fabric as described in claim 1, wherein;

said stud placement member is pivotable and has a notched end for receiving a portion of a stud that is delivered to said pivotable stud support.

3. An automated apparatus for attaching studs to fabric as described in claim 2, wherein:

said notched end of said stud placement member is arcuate.

4. An automated apparatus for attaching studs to fabric as described in claim 2 further comprising:

an adjusting member abutting said pivotable stud placement member for adjusting the position of said notched end of said pivotable stud placement member relative to said feeder;

a biasing spring coupled to said pivotable stud placement member for biasing said notched end of said pivotable stud placement member towards said feeder; and, a spring element coupled to said pivotable stud support member for urging said pivotable stud support member into its first position.

5. An automated apparatus for attaching studs to fabric as described in claim 1, further comprising:

a pivotable anti-jam lever coupled to said pivotable stud support for selectively moving said pivotable stud support between its first position and its second position.

6. An automated apparatus for attaching studs to fabric as described in claim 1, further comprising:

a rotatable anti-jam knob coupled to said pivotable stud support for selectively moving said pivotable stud support between its first position and its second position.

7. An automated apparatus for attaching studs to fabric as described in claim 6, wherein said stud placement member comprises an elongated body portion, and an angled lower tip portion that extends out from said elongated body portion.

8. An automated apparatus for attaching studs to fabric as described in claim 1 wherein said feeder comprises:

a supply bowl; and, a ramp member having a hollow channel open at opposite ends thereof and shaped to accommodate a plurality of studs delivered from said supply bowl.

9. An automated apparatus for attaching studs to fabric as described claim 1, further comprising:

a spring coupled between said stud positioning member and said stud driving member.

10. An automated apparatus for attaching studs to fabric as described in claim 1 wherein:

said stud fastening member has a circular groove for said bending of at least one leg of a stud.

11. An automated apparatus for attaching studs to fabric as described in claim 1 wherein:

said stud positioning member has a slot for receiving a portion of said pivotable stud support.

12. An automated apparatus for attaching studs to fabric as described in claim 1 wherein:

said stud engaging section of said stud driving member is concave.

13. An automated apparatus for attaching studs to fabric with each of the studs having a head portion and at least one leg comprising:

a feeder for supplying studs to the apparatus;

a pivotable stud support shaped to allow a stud delivered from said feeder to rest thereon, said pivotable stud support being movable between a first position and a second position;

a pivotable stud placement member having a notched end for receiving a portion of a stud that rests on said pivotable stud support;

a stud driving member movable between a first non-engaged position and a second engaged position, said stud driving member having a stud engaging section for receiving a stud resting on said pivotable stud support;

a stud positioning member movable with and relative to said stud driving member and configured to displace said pivotable placement member and said pivotable stud support;

a stud driving member actuator for moving said stud driving member between said first non-engaged position and said second engaged position; and a stud fastening member disposed below said stud driving member for bending at least one leg of a stud upon said stud driving member moving from its first non-engaged position to its second engaged position.

14. An automated apparatus for attaching preformed studs to fabric with each of the preformed studs having a head portion and at least one leg comprising:

a feeder for supplying studs to the apparatus;

a pivotable stud support shaped to allow a stud delivered from said feeder to rest thereon, said pivotable stud support being movable between a first position and a second position;

a pivotable stud placement member having a notched end for receiving a portion of a stud that rests on said pivotable stud support;

a stud driving member movable between a first non-engaged position and a second engaged position, said stud driving member having a stud engaging section for receiving a stud resting on said pivotable stud support;

a stud positioning member having a slot for receiving a portion of said pivotable stud support, said stud positioning member being movable with and relative to said stud driving member and configured to displace said pivotable placement member and said pivotable stud support; and, a stud fastening member disposed below said stud driving member for bending at least one leg of a stud upon said stud driving member moving from its first non-engaged position to its second engaged position.

* * * * *